US011846216B2

(12) United States Patent
Ahn

(10) Patent No.: US 11,846,216 B2
(45) Date of Patent: Dec. 19, 2023

(54) EXHAUST SYSTEM NOISE REDUCTION DEVICE OF VEHICLE

(71) Applicants: Hyundai Motor Company, Seoul (KR); Kia Motors Corporation, Seoul (KR)

(72) Inventor: Hyeon Gyun Ahn, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 226 days.

(21) Appl. No.: 17/109,712

(22) Filed: Dec. 2, 2020

(65) Prior Publication Data

US 2021/0355850 A1 Nov. 18, 2021

(30) Foreign Application Priority Data

May 13, 2020 (KR) ..... 10-2020-0056946

(51) Int. Cl.
*F01N 1/02* (2006.01)
*F01N 1/08* (2006.01)

(52) U.S. Cl.
CPC ..... *F01N 1/023* (2013.01); *F01N 2470/04* (2013.01); *F01N 2470/14* (2013.01); *F01N 2490/08* (2013.01); *F01N 2490/155* (2013.01)

(58) Field of Classification Search
CPC . F01N 1/023; F01N 1/02; F01N 1/089; F01N 1/08; F01N 13/04; F01N 2470/04; F01N 2470/14; F01N 2470/16; F01N 2490/08; F01N 2490/155; F01N 2490/15; F01N 2490/14; F01N 2490/02
See application file for complete search history.

(56) References Cited

U.S. PATENT DOCUMENTS 3,072,214 A * 1/1963 Deremer ..... F01N 1/08 60/313
3,434,565 A * 3/1969 Fischer ..... F01N 1/023 181/250
3,447,629 A * 6/1969 Placek ..... F01N 1/084 181/266
3,583,524 A * 6/1971 Dubois ..... F01N 1/02 181/266

(Continued)

FOREIGN PATENT DOCUMENTS

EP 1541823 A2 * 6/2005 ..... F01N 1/04
EP 1908930 A2 * 4/2008 ..... F01N 1/023
KR 910007632 B1 * 9/1991 ..... F01N 1/02

*Primary Examiner* — Edgardo San Martin
(74) *Attorney, Agent, or Firm* — Fox Rothschild LLP

(57) ABSTRACT

An exhaust system noise reduction device of a vehicle enables an exhaust system to contribute to an increase in engine output while reducing engine exhaust noise. The exhaust system noise reduction device includes a muffler housing formed to airtightly surround a rear end section of an exhaust pipe; a branch pipe branched from a front end section of the exhaust pipe while having a rear end section of the branch pipe extend through the muffler housing; a barrier wall disposed at a peripheral surface of the rear end section of the exhaust pipe to divide an inner space of the muffler housing into a first chamber and a second chamber; and a punched portion formed at the rear end section of the branch pipe and disposed in the first chamber. A resonance chamber structure for reducing exhaust noise is formed in the first chamber, thereby reducing exhaust noise.

7 Claims, 4 Drawing Sheets

(56) References Cited

U.S. PATENT DOCUMENTS 4,333,544 A * 6/1982 Seeger ..... F01N 1/02 181/266
4,381,832 A * 5/1983 Rauch ..... F01N 1/084 181/266
4,501,341 A * 2/1985 Jones ..... F01N 1/02 181/272
5,647,314 A * 7/1997 Matsumura ..... F02M 35/1255 123/184.57
5,979,583 A * 11/1999 Amino ..... F01N 1/08 181/251
5,984,045 A * 11/1999 Maeda ..... F01N 1/166 181/254
6,173,808 B1 * 1/2001 Maeda ..... F01N 1/02 181/254
6,644,437 B1 * 11/2003 Hayman ..... F02B 75/22 181/268
7,004,283 B2 * 2/2006 Worner ..... F01N 1/06 181/269
7,337,609 B2 * 3/2008 Mahnken ..... F01N 3/023 181/254
7,438,157 B2 * 10/2008 Schorn ..... F01N 1/006 181/254
7,870,930 B2 * 1/2011 Bogard ..... F01N 1/084 181/266
7,942,235 B2 * 5/2011 Mirlach ..... F01N 13/011 181/227
8,528,693 B1 * 9/2013 Park ..... F01N 1/083 181/239
9,133,753 B2 * 9/2015 Vollmer ..... F01N 1/003
9,695,719 B2 * 7/2017 Arai ..... F01N 1/084
10,823,022 B2 * 11/2020 Soatti ..... F01N 1/16
10,837,333 B2 * 11/2020 Ayesh ..... F01N 1/023
10,890,118 B2 * 1/2021 Miura ..... F02D 9/04
11,346,270 B2 * 5/2022 Miura ..... G10K 11/162
2004/0006970 A1 * 1/2004 Worner ..... F01N 1/166 60/272
2007/0102236 A1 * 5/2007 Uhlemann ..... F01N 1/023 181/250

* cited by examiner

EXHAUST SYSTEM NOISE REDUCTION DEVICE OF VEHICLE

CROSS-REFERENCE TO RELATED APPLICATION

This application claims under 35 U.S.C. § 119(a) the benefit of Korean Patent Application No. 10-2020-0056946 filed on May 13, 2020, the entire contents of which are incorporated herein by reference.

BACKGROUND

(a) Technical Field

The present disclosure relates to an exhaust system noise reduction device of a vehicle, more particularly, to the exhaust system noise reduction device capable of contributing to an increase in engine output in a vehicle exhaust system while reducing exhaust noise.

(b) Description of the Related Art

Generally, manual transmissions transmit power of an engine to wheels via a clutch, whereas automatic transmissions transmit power of an engine to wheels via a torque converter.

A manual transmission has an advantage in that a theoretical transmission efficiency reaches a level of about 98% in accordance with transmission of power in a mechanical friction manner via the clutch, but there is a drawback in that vibration and noise of a vehicle increase.

On the other hand, an automatic transmission transmits power in a torque converter manner using a fluid in order to solve a drawback of the manual transmission. In accordance with power transmission using flow of a fluid, there is an advantage of an enhancement in vehicle vibration and noise performance. However, there is a drawback in that loss of power transmission efficiency may be generated, and as such, fuel economy may be degraded.

Recently, in order to solve the problem of loss of power transmission efficiency in the automatic transmission, a proposed solution involves operating the automatic transmission in a manual transmission mode by directly connecting the torque converter to an engine output shaft during driving of a vehicle. Such a technology is referred to as a lock-up condition or a lock-up mode.

In lock-up mode control, when conditions such as vehicle speed, throttle opening degree and gear stage meet a lock-up mode, the automatic transmission enters a direct connection stage upon reaching a predetermined RPM under control of an engine controller and a transmission controller.

Meanwhile, when transmission direct connection occurs in a lock-up mode, that is, when the automatic transmission enters a direct connection stage in the lock-up mode, a time when ignition in an engine cylinder occurs in a stage before direct connection differs from that in a stage after direct connection.

In other words, the engine ignition time varies in the lock-up mode in accordance with a gear stage of the automatic transmission.

A variation in combustion spectrum in the engine cylinder may occur due to a variation in engine ignition time. As a result, exhaust noise caused by engine explosion may increase.

In particular, direct transmission connection has recently been applied even to a low-frequency range in the vicinity of 1,000 rpm, and as such, there is a problem in that exhaust booming noise may be excessively generated.

SUMMARY

The present disclosure provides an exhaust system noise reduction device of a vehicle capable of reducing exhaust noise through formation of a resonance chamber in a muffler system of an exhaust system.

Objects of the present disclosure are not limited to the above-described objects, and other objects of the present disclosure not yet described will be more clearly understood by those skilled in the art from the following detailed description. In addition, objects of the present disclosure may be accomplished by means defined in the appended claims and combinations thereof.

In one aspect, the present disclosure provides an exhaust system noise reduction device of a vehicle including a muffler housing formed to airtightly surround a rear end section of an exhaust pipe into which exhaust gas of an engine is introduced, a branch pipe formed to be branched from a front end section of the exhaust pipe while having a rear end section of the branch pipe extend through the muffler housing, a barrier wall disposed at a peripheral surface of the rear end section of the exhaust pipe to divide an inner space of the muffler housing into a first chamber and a second chamber, and a punched portion formed at the rear end section of the branch pipe and disposed in the first chamber.

In a preferred embodiment, the punched portion may include a plurality of resonance holes formed at a peripheral surface of the rear end section of the branch pipe, and a branch outlet may be formed at an end of the rear end section of the branch pipe and may be closed by a cap, so as to be sealed.

In another preferred embodiment, the barrier wall may be disposed rearwards of the punched portion such that the punched portion is disposed only in the first chamber and, as such, the first chamber may be a sealed space communicating with an outside of the first chamber only through the punched portion.

In still another preferred embodiment, an exhaust outlet may be formed at an end of the rear end section of the exhaust pipe, and may be disposed in the second chamber while passing through the barrier wall.

In yet another preferred embodiment, a first pipe and a second pipe, which are formed to communicate with the second chamber may be mounted to the muffler housing. The first pipe may be connected to a first muffler disposed outside the muffler housing such that the first pipe communicates with the first muffler. The second pipe may be connected to a second muffler disposed outside the muffler housing such that the second pipe communicates with the second muffler.

Other aspects and preferred embodiments of the disclosure are discussed infra.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

Figure 1:
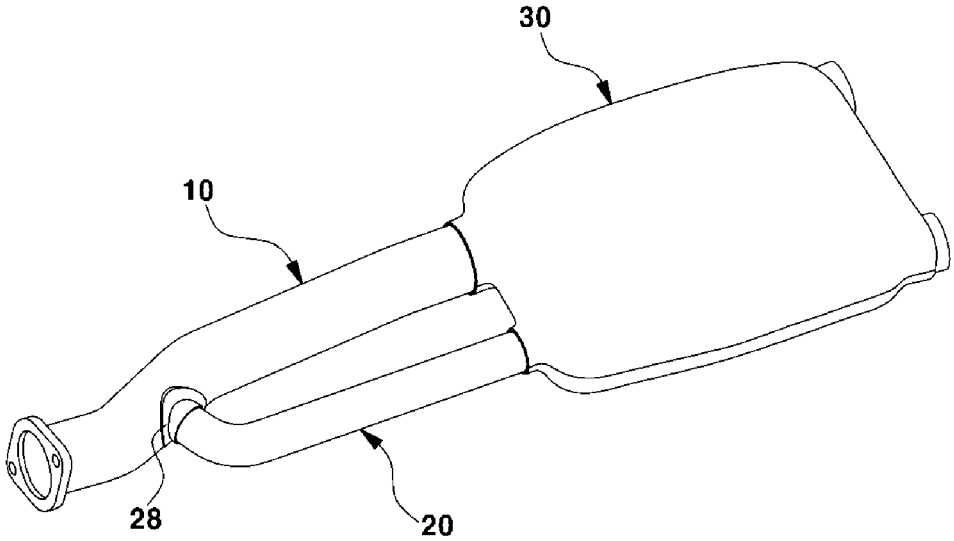
FIG. 1 is a perspective view illustrating an appearance of an exhaust system noise reduction device according to the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter, reference will be made in detail to various embodiments of the present disclosure, examples of which are illustrated in the accompanying drawings and described below.

In an exhaust system noise reduction device of the present disclosure, a resonance chamber capable of enhancing an effect of reducing noise in a predetermined frequency range is formed in an exhaust system muffler contributing to an increase in engine output while reducing engine exhaust noise, thereby achieving a reduction in exhaust booming noise generated during fuel explosion in an engine cylinder.

Figure 2:
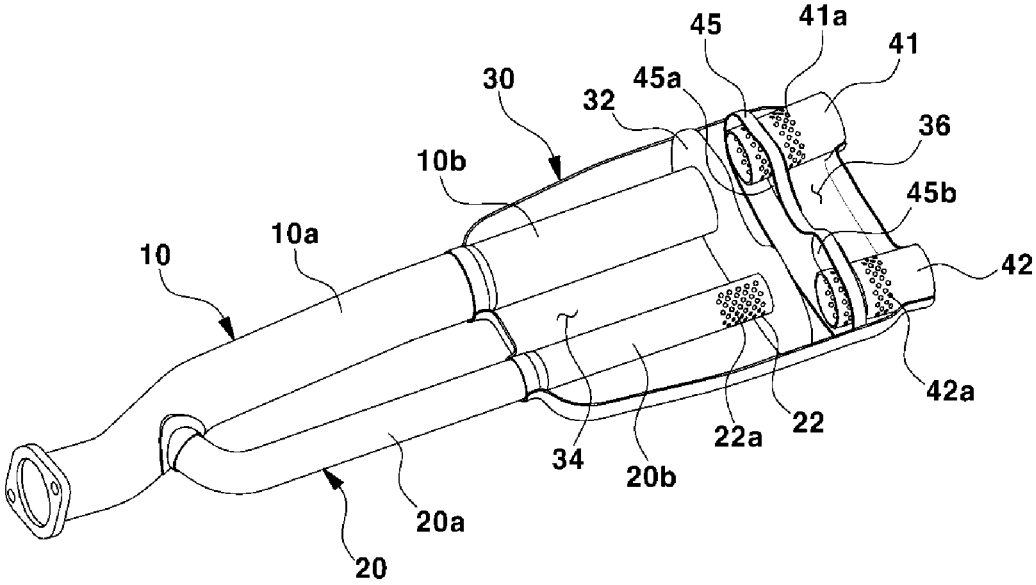
FIG. 2 is a partially-broken perspective view illustrating the exhaust system noise reduction device according to the present disclosure.
Figure 3:
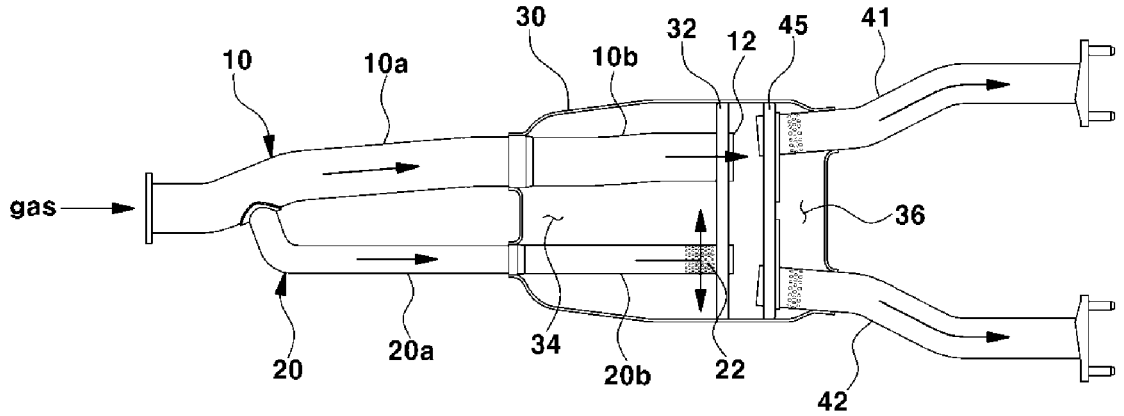
FIG. 3 is a partially broken plan view illustrating the exhaust system noise reduction device according to the present disclosure.

FIGS. 1 to 3 illustrate an exhaust system noise reduction device according to an exemplary embodiment of the present disclosure.

As illustrated in FIGS. 1 to 3, the exhaust system noise reduction device includes a branch pipe 20 formed to be branched from a front end section 10*a* of an exhaust pipe 10.

The exhaust pipe 10 is formed to have the form of a hollow pipe capable of achieving introduction and discharge of exhaust gas therethrough. The exhaust pipe 10 is connected to an exhaust outlet of an engine such that exhaust gas discharged from the engine is introduced into the exhaust pipe 10.

The exhaust pipe 10 may be divided into the front end section 10*a*, which is connected to the engine, and a rear end section 10*b* connected to a muffler housing 30, when viewed in a flow direction of exhaust gas.

The front end section 10*a* of the exhaust pipe 10 is disposed outside the muffler housing 30, whereas the rear end section 10*b* of the exhaust pipe 10 is disposed inside the muffler housing 30.

The muffler housing 30 is formed to airtightly surround the rear end section 10*b* of the exhaust pipe 10. Exhaust gas discharged from the engine is introduced into the muffler housing 30 through the exhaust pipe 10.

The branch pipe 20 may be formed to have the form of a hollow pipe capable of achieving introduction and discharge of exhaust gas therethrough, and may be divided into a front end section 20*a* connected to the side of the exhaust pipe 10, and a rear end section 20*b* connected to the side of the muffler housing 30.

The front end section 20*a* of the branch pipe 20 is disposed outside of the muffler housing 30 while being connected to the front end section 10*a* of the exhaust pipe 10 in a protruding state. The rear end section 20*b* of the branch pipe 20 is disposed inside the muffler housing 30 while being airtightly surrounded by the muffler housing 30.

In particular, an inlet 28 formed at an end of the front end section 20*a* in the branch pipe 20 is connected to a peripheral surface of the front end section 10*a* in the exhaust pipe 10 such that the inlet 28 communicates with the front end section 10*a* of the exhaust pipe 10. A branch outlet 24 formed at an end of the rear end section 20*b* in the branch pipe 20 is disposed within an inner space of the muffler housing 30.

In addition, a punched portion 22 is formed at the rear end section 20*b* of the branch pipe 20 in order to allow an inner channel of the branch pipe 20 to communicate with the inner space of the muffler housing 30.

The punched portion 22 includes a plurality of resonance holes 22*a* disposed at a peripheral surface of the rear end section 20*b* in the branch pipe 20 in a punched state. By virtue of the punched portion 22, the front end section 20*a* of the branch pipe 20 and the inner space of the muffler housing 30 are connected to communicate with each other.

The rear end section 20*b* of the branch pipe 20 formed with the punched portion 22 is disposed within the inner space of the muffler housing 30 (in particular, a first chamber) while extending through a front end section of the muffler housing 30.

A barrier wall 32 is mounted in the muffler housing 30 such that the barrier wall 32 is disposed at a peripheral surface of the rear end section 10*b* in the exhaust pipe 10 and the peripheral surface of the rear end section 20*b* in the branch pipe 20.

The barrier wall 32 is formed to divide the inner space of the muffler housing 30 into a first chamber 34 and a second chamber 36. The barrier wall 32 prevents direct gas flow between the first chamber 34 and the second chamber 36.

That is, the first chamber 34 is separated from the second chamber 36 by the barrier wall 32 such that gas flow between the first chamber 34 and the second chamber 36 is prevented.

In addition, the barrier wall 32 is disposed at the peripheral surface of the rear end section 10*b* of the exhaust pipe 10 such that the barrier wall 32 is disposed forwards of the exhaust outlet 12 formed at the end of the rear end section 10*b* in the exhaust pipe 10. Accordingly, exhaust gas introduced from the engine into the exhaust pipe 10 can be introduced only into the second chamber 36.

Furthermore, the barrier wall 32 is disposed rearwards of the punched portion 22 of the branch pipe 20 such that the punched portion 22 is disposed in the first chamber 34. In other words, the barrier wall 32 is mounted within the muffler housing 30 such that the barrier wall 32 is disposed rearwards of the resonance holes 22*a* formed at the peripheral surface of the rear end section 20*b* in the branch pipe 20.

In particular, the barrier wall 32 may be formed to closely contact the peripheral surface of the branch pipe 20 behind the punched portion 22. Accordingly, the first chamber 34 may communicate with the outside of the first chamber 34 only through the punched portion 22.

In other words, the first chamber 34 is a sealed space isolated from the outside of the first chamber 34, except for the punched portion 22. Here, the outside of the first chamber 34 includes not only the outside of the muffler housing 30, but also spaces such as the inner channel of the branch pipe 20, the inner channel of the exhaust pipe 20, and the second chamber 36. That is, the inner channel of the branch pipe 20, the inner channel of the exhaust pipe 10, the second chamber 36, etc. correspond to a space outside the first chamber 34.

Figure 4:
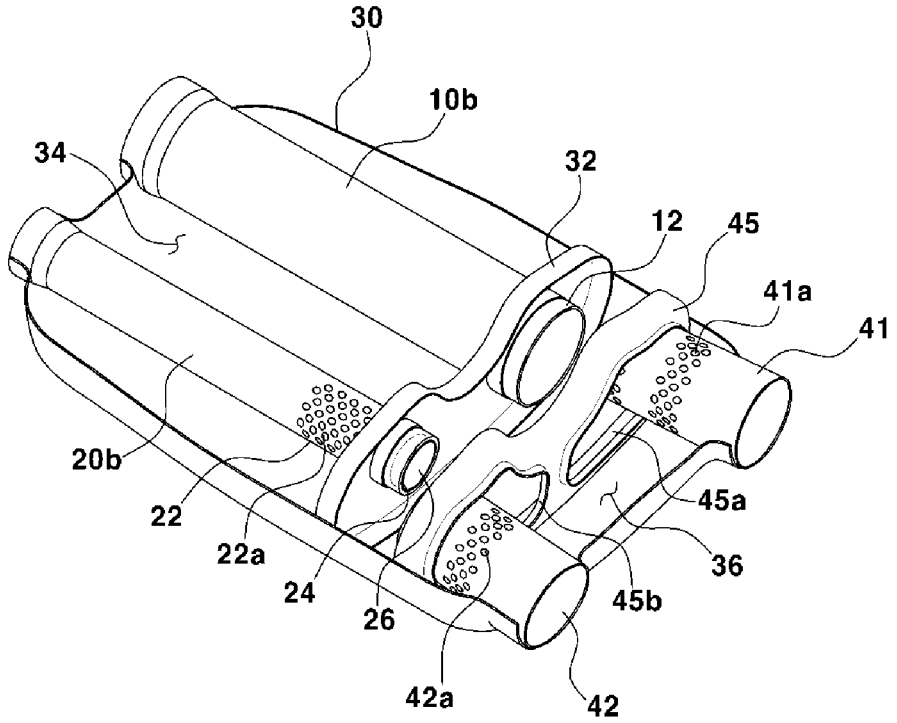
FIG. 4 is a rear view illustrating an inner structure of a muffler housing according to the present disclosure.

In addition, as illustrated in FIG. 4, when the branch outlet 24 provided at the end of the rear end section 20*b* in the branch pipe 20 is disposed in the second chamber 36, that is, when the end of the rear end section 20*b* in the branch pipe 20 is disposed in the second chamber 36 while passing through the barrier wall 32, the branch outlet 24 of the branch pipe 20 is closed by a cap 26 such that the branch outlet 24 is sealed, in order to prevent the first chamber 34 and the second chamber 36 from communicating with each other through the branch outlet 24 and the punched portion 22 in the branch pipe 20.

The cap 26 is airtightly mounted to the branch outlet 24, and as such, exhaust gas cannot be discharged into the second chamber 36 through the branch outlet 24.

Although not shown, the branch outlet 24 may be disposed in the first chamber 34 in a state of being closed by the cap 26.

In addition, in the case of the exhaust pipe 10, the rear end section 10*b* thereof is disposed in the second chamber 36 while passing through the barrier wall 32.

The exhaust outlet 12 provided at the end of the rear end section 10*b* in the exhaust pipe 10 is disposed in the second chamber 36 such that the exhaust outlet 12 communicates with the second chamber 36. As such, the exhaust pipe 10 may communicate with the outside of the muffler housing 30 through the second chamber 36. Exhaust gas discharged from the engine is introduced into the second chamber 36 through the exhaust outlet 12 of the exhaust pipe 10.

In the exhaust system noise reduction device configured as described above, the first chamber 34 functions as a resonance chamber for reducing exhaust noise in a predetermined frequency range.

Figure 6:
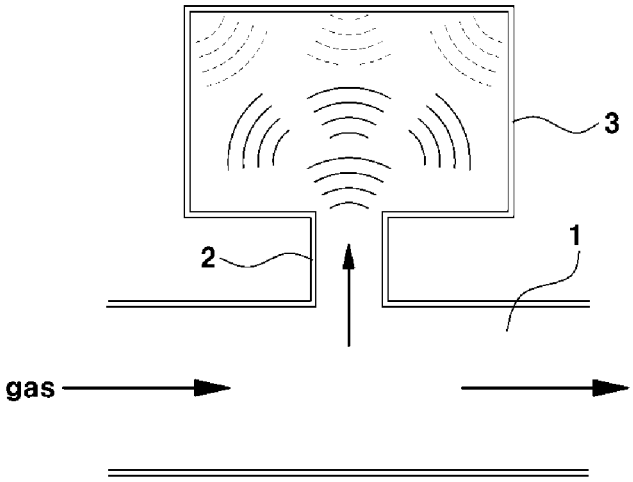
FIG. 6 is a view illustrating a basic structure of a Helmholtz resonator.

FIG. 6 is a schematic view illustrating the structure of a Helmholtz resonator.

Referring to FIG. 6, in the Helmholtz resonator, when gas flows through a channel 1, a part of the gas passing through the channel 1 is introduced into a resonance chamber 3 through a neck 2, and is diffused in the resonance chamber 3. As the diffused gas strikes a wall surface of the resonance chamber 3, resonance action to attenuate noise of the gas is generated.

Referring to FIG. 3, among configurations of the exhaust system noise reduction device, the exhaust pipe 10 performs a function corresponding to the channel 1 of the Helmholtz resonator, and the first chamber 34 functions as the resonance chamber 3.

Accordingly, when exhaust gas flows through the exhaust pipe 10, a Helmholtz resonance phenomenon occurs in the first chamber 34, and as such, exhaust noise in a predetermined frequency range may be effectively reduced.

That is, when exhaust gas flows through the exhaust pipe 10, the exhaust gas is introduced into the first chamber 34 through the punched portion 22 of the branch pipe 20, and is diffused in the first chamber 34. Simultaneously with diffusion thereof, the exhaust gas strikes a wall surface of the first chamber 34 (i.e., an inner wall surface of the muffler housing 30), and is then reflected from the wall surface. As a result, portions of the reflected exhaust gas collide with each other and, as such, are offset with each other. Thus, resonance action to attenuate exhaust noise is generated.

A target frequency for noise reduction of exhaust gas passing through the exhaust pipe 10 (that is, a resonance frequency) may be determined by adjusting the cross-sectional area of the punched portion 22, the volume of the first chamber 34, the channel length of the branch pipe 20, etc. Here, the cross-sectional area of the punched portion 22 is a total cross-sectional area obtained by summing cross-sectional areas of the resonance holes 22*a* constituting the punched portion 22. In particular, the resonance frequency may be determined as the following Expression 1.

$$f = \frac{c}{2\pi}\sqrt{\frac{S}{VL'}},\ L' = L + 1.7a \qquad \text{Expression 1}$$

In Expression 1, f is a target frequency for noise reduction (that is, a resonance frequency, c is a sound velocity of exhaust noise, S is a cross-sectional area of the punched portion 22, V is a volume of the first chamber 34, L is a channel length of the branch pipe 20, and a is a radius of the branch pipe 20.

L' is an effective length obtained by adding a compensation value (1.7a) to the channel length of the branch pipe 20. The reason why the compensation value (1.7a) is added to the channel length L of the branch pipe 20 is to compensate for an effect added to a fluid in the branch pipe 20 due to a fluid present around the branch pipe 20 (i.e., at the outside of the branch pipe 20).

When resonance occurs in the first chamber 34, an effect of reducing exhaust booming noise in a predetermined frequency range with reference to the resonance frequency determined in accordance with Expression 1 may be obtained. For example, when the resonance frequency is set to 40 Hz, exhaust noise generated in an engine driving range of 1,200 to 1,600 rpm may be more effectively alleviated.

Meanwhile, when it is desired to obtain a resonance effect for a 47 Hz frequency component in an engine driving range of 1,100 to 1,600 rpm, that is, when the resonance frequency is set to 47 Hz, the outer diameter of the branch pipe 20 may be determined to be 38.1 mm through Expression 1.

Figure 7:
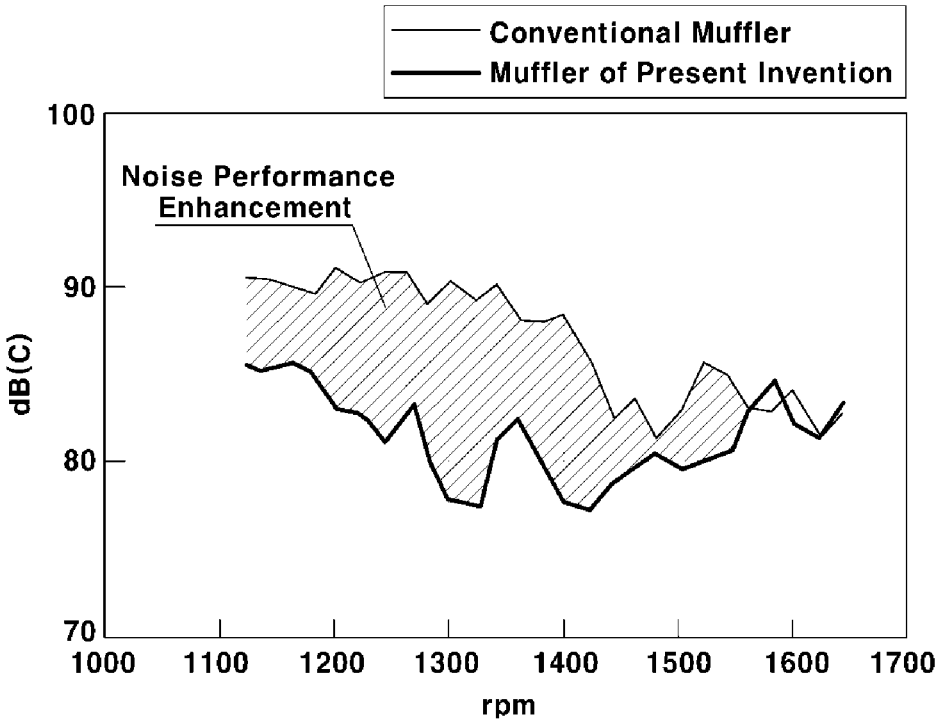
FIG. 7 is an experimental graph showing a noise reduction effect of an exhaust system muffler system to which a resonance chamber structure according to the present disclosure is applied.

Referring to FIG. 7, in the case of an exhaust system muffler system in which a center muffler (with no application of a resonance chamber structure) is disposed between an engine and a main muffler, as in conventional cases, exhaust noise is reduced, at the minimum, to a level of 82 dB in a range of 1,100 to 1,550 rpm. However, in the case of an exhaust system muffler system in which a center muffler according to the present disclosure (to which a muffler housing to which a resonance chamber structure is applied) is disposed between an engine and a main muffler, not only is noise reduction performance enhanced throughout the range of 1,100 to 1,550 rpm, as compared to the conventional muffler system, but also exhaust noise is reduced, at the minimum, to a level of 77 dB throughout the range of 1,100 to 1,550 rpm. In particular, in the case of the muffler system according to the present disclosure, it can be seen that noise reduction performance is high in the vicinity of a range of 1,300 to 1,400 rpm.

Figure 5:
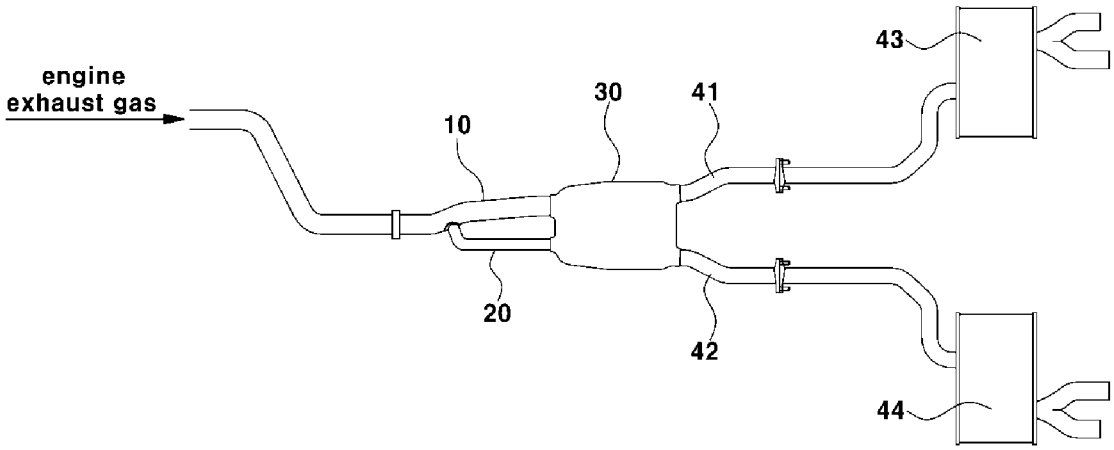
FIG. 5 is a schematic view illustrating a muffler system to which the exhaust system noise reduction device according to the present disclosure is applied.

Meanwhile, as illustrated in FIGS. 3 to 5, exhaust gas introduced into the second chamber 36 through the exhaust outlet 12 of the exhaust pipe 10 can flow into a first muffler 43 and a second muffler 44 disposed outside the muffler housing 30 through the first pipe 41 and the second pipe 42.

The first pipe 41 and the second pipe 42 are mounted to a rear end of the muffler housing 30 while extending through the rear end. The first pipe 41 and the second pipe 42 may be formed to communicate with the second chamber 36.

The first pipe 41 and the second pipe 42 are mounted to the muffler housing 30 such that, when viewed in a gas flow direction, front end portions thereof are held by a support 45 disposed in the second chamber 36, and rear ends thereof are formed to extend to the outside of the muffler housing 30 and are connected to the first muffler 43 and the second muffler 44 to communicate therewith, respectively.

In addition, the support 45 includes a first hole 45*a* and a second hole 45*b*, through which the first pipe 41 and the second pipe 42 extend to be held by the support 45. The first hole 45*a* and the second hole 45*b* may be formed to have a diameter greater than outer diameters of the first and second pipes 41 and 42.

Furthermore, a plurality of punched holes 41*a* and a plurality of punched holes 42*a*, through which gas flow is possible, are formed at peripheral surfaces of front end sections in the first and second pipes 41 and 42, respectively.

In addition, the muffler housing 30 is disposed between the engine and the first and second mufflers 43 and 44. Accordingly, exhaust gas generated in the engine is noise-attenuated in the first chamber 34 of the muffler housing 30 in accordance with resonance, and is then noise-attenuated in the first muffler 43 and the second muffler 44. Subsequently, the exhaust gas is discharged to the outside of the exhaust system through a tail pipe.

In the exhaust system noise reduction device according to the present disclosure, a Helmholtz resonance phenomenon occurs in the first chamber when exhaust gas discharged from the engine passes through the exhaust pipes, and as such, exhaust noise in a predetermined frequency range may be effectively reduced.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. An exhaust system noise reduction device of a vehicle, comprising:

a muffler housing extending between a front end and a rear end and formed to airtightly surround a rear end section of an exhaust pipe into which exhaust gas of an engine is introduced, wherein the exhaust pipe extends through the front end of the muffler housing;

a branch pipe formed to be branched from a front end section of the exhaust pipe while having a rear end section of the branch pipe extend through the muffler housing, wherein branch pipe extends through the front end of the muffler housing;

a barrier wall disposed at a peripheral surface of the rear end section of the exhaust pipe to divide an inner space of the muffler housing into a first chamber and a second chamber;

a first punched portion formed at the rear end section of the branch pipe and disposed in the first chamber;

a first pipe and a second pipe extending through the rear end of the muffler housing, each of the first and second pipes having front end portions with inlets positioned within the second chamber; and second punched portions formed in the first and second pipe, respectively, and positioned between the barrier wall and the rear end of the muffler housing, wherein the barrier wall is disposed rearwards of the punched portion such that the punched portion is disposed only in the first chamber, wherein the first chamber is a sealed space communicating with an outside of the first chamber only through the punched portion.

2. The exhaust system noise reduction device according to claim 1, wherein the punched portion comprises a plurality of resonance holes formed at a peripheral surface of the rear end section of the branch pipe.

3. The exhaust system noise reduction device according to claim 1, wherein a branch outlet is formed at an end of the rear end section of the branch pipe, and is closed by a cap, so as to be sealed.

4. The exhaust system noise reduction device according to claim 1, wherein an exhaust outlet is formed at an end of the rear end section of the exhaust pipe, and is disposed in the second chamber while passing through the barrier wall.

5. The exhaust system noise reduction device according to claim 1, wherein:

wherein the first pipe and the second pipe are mounted to the muffler housing;

the first pipe is connected to a first muffler disposed outside the muffler housing such that the first pipe communicates with the first muffler; and the second pipe is connected to a second muffler disposed outside the muffler housing such that the second pipe communicates with the second muffler.

6. The exhaust system noise reduction device according to claim 1, wherein the exhaust pipe communicates with the outside of the muffler housing through the second chamber.

7. The exhaust system noise reduction device according to claim 3, wherein the cap is airtightly mounted to the branch outlet, and exhaust gas is not discharged into the second chamber through the branch outlet.

* * * * *